US009205530B2

(12) United States Patent
Moudry et al.

(10) Patent No.: US 9,205,530 B2
(45) Date of Patent: Dec. 8, 2015

(54) LAPPING A WORKPIECE

(75) Inventors: Raymond Leroy Moudry, Bloomington, MN (US); Vishwanath Ramaswamy, Lakeville, MN (US); Joel William Hoehn, Hudson, WI (US); Albert Enrique Singh, Shakopee, MN (US)

(73) Assignee: SEAGATE TECHNOLOGY LLC, Scotts Valley, CA (US)

( * ) Notice: Subject to any disclaimer, the term of this patent is extended or adjusted under 35 U.S.C. 154(b) by 844 days.

(21) Appl. No.: 12/831,401

(22) Filed: Jul. 7, 2010

(65) Prior Publication Data

US 2012/0009856 A1 Jan. 12, 2012

(51) Int. Cl.

| | |
|---|---|
| ***B24D 3/06*** | (2006.01) |
| ***B24B 7/16*** | (2006.01) |
| ***B24D 3/28*** | (2006.01) |
| ***B24D 7/06*** | (2006.01) |

(52) U.S. Cl.
CPC .. *B24D 3/06* (2013.01); *B24D 3/28* (2013.01); *B24D 7/06* (2013.01)

(58) Field of Classification Search
USPC ..... 451/550, 526, 527, 530, 532, 534, 539, 451/540, 546–548
See application file for complete search history.

(56) References Cited

U.S. PATENT DOCUMENTS

| | | | | |
|---|---|---|---|---|
| 3,683,562 | A | | 8/1972 | Day |
| 3,921,342 | A | | 11/1975 | Day |
| 4,037,367 | A | | 7/1977 | Kruse |
| 4,536,992 | A | | 8/1985 | Hennenfent et al. |
| 4,799,939 | A | * | 1/1989 | Bloecher et al. ..... 51/293 |
| 4,821,461 | A | | 4/1989 | Holmstrand |
| 4,866,886 | A | | 9/1989 | Holmstrand |
| 5,039,311 | A | * | 8/1991 | Bloecher ..... 51/295 |
| 5,049,165 | A | * | 9/1991 | Tselesin ..... 51/295 |
| 5,152,917 | A | | 10/1992 | Pieper et al. |
| 5,669,943 | A | * | 9/1997 | Horton et al. ..... 51/307 |
| 5,725,421 | A | * | 3/1998 | Goers et al. ..... 451/303 |
| 5,916,655 | A | | 6/1999 | Kwon |
| 6,017,264 | A | | 1/2000 | Strom |
| 6,074,283 | A | | 6/2000 | Maeda et al. |
| 6,190,240 | B1 | * | 2/2001 | Kinoshita et al. ..... 451/56 |
| 6,475,064 | B2 | | 11/2002 | Hao et al. |
| 6,702,654 | B2 | * | 3/2004 | Nanda et al. ..... 451/56 |
| 6,951,504 | B2 | * | 10/2005 | Adefris et al. ..... 451/28 |
| 7,326,102 | B2 | | 2/2008 | Fujii et al. |
| 7,329,171 | B2 | | 2/2008 | Goetz |
| 7,410,410 | B2 | | 8/2008 | Mahadev et al. |
| 7,491,116 | B2 | * | 2/2009 | Sung ..... 451/56 |
| 7,662,021 | B2 | | 2/2010 | Gee et al. |
| 2007/0084131 | A1 | | 4/2007 | Palmgren |
| 2010/0003904 | A1 | | 1/2010 | Duescher |

* cited by examiner

*Primary Examiner* — Dung Van Nguyen

(74) *Attorney, Agent, or Firm* — Hall Estill Attorneys at Law

(57) ABSTRACT

An apparatus and associated method for constructing an abrading tool having a desired surface texture for a lapping surface of the tool. The abrading tool has a platen defining an external surface and a cavity intersecting the external surface. An adhesive is disposed in the cavity. An abrasive member is adhered at a proximal end thereof to the platen in the cavity by the adhesive so that the abrasive member extends beyond the external surface at a distal end thereof to define the lapping surface.

21 Claims, 6 Drawing Sheets

LAPPING A WORKPIECE

SUMMARY

In some embodiments an abrading tool is provided having a desired surface texture for a lapping surface of the tool. The abrading tool has a platen defining an external surface and a cavity intersecting the external surface. An adhesive is disposed in the cavity. An abrasive member is adhered at a proximal end thereof to the platen in the cavity by the adhesive so that the abrasive member extends beyond the external surface at a distal end thereof to define the lapping surface.

In some embodiments a method is provided for manufacturing an abrading tool to have a desired surface texture for a lapping surface of the tool. The method includes the steps of obtaining a platen defining an external surface and a cavity intersecting the external surface; applying an adhesive to the platen in the cavity; adhering an abrasive member to the platen by the adhesive at a proximal end of the abrasive member so that a distal end of the abrasive member extends beyond the external surface to define the lapping surface.

In some embodiments an abrading tool is provided for lapping a workpiece. The abrading tool has a platen that is selectively moveable in relation to the workpiece, and means for supporting abrasive members from the platen to define a desired surface texture for a lapping surface of the tool.

DESCRIPTION

The present embodiments relate most generally to the manufacture of abrading tools. For purposes of this description, although not so limited, reference is made to the use of an abrading tool in high precision lapping of magnetic transducing heads (referred to as "heads") used in data storage devices. The heads, operably used to store and retrieve data on rotatable magnetic recording discs, require extremely precise manufacturing tolerances. The heads are typically formed by applying layers of an electrically conductive material and a magnetic flux conducting core along one side of a comparatively large support member, referred to as a slider. An air bearing surface ("ABS") is precisely machined into the slider that aerodynamically supports the slider upon a thin film of air generated by the spinning recording disc. This maintains a desired spatial separation between the slider and the recording disc suitable for reliable data transfer operations between the head and the disc. Although generally referred to as an "air" bearing surface, the skilled artisan understands that in some instances the term is used universally even when the slider is similarly aerodynamically supported upon a fluid (likewise generated by the spinning disc) that is other than air, such as but not limited to an inert gas environment.

Figure 1:
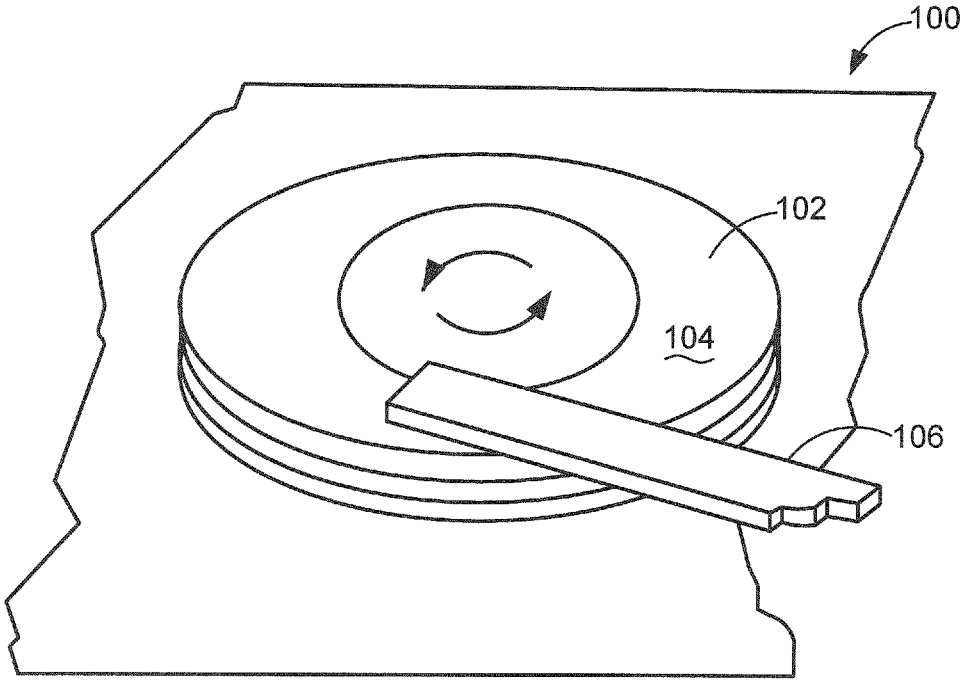
FIG. 1 is an isometric diagrammatical depiction of an abrading tool that is constructed in accordance with embodiments of the present invention.

FIG. 1 diagrammatically depicts an abrading tool 100 used for machining the ABS in accordance with embodiments of the present invention. The abrading tool 100 has a rotating lapping plate 102 defining a lapping surface 104 in which abrasive members (shown below) are embedded. An abrasive slurry can be applied to the lapping surface 104 to enhance the abrading action as the lapping surface 104 is rotated relative to a slider bar 106 containing a plurality of the sliders held in a pressing engagement against the lapping surface 104.

The abrading action that removes material from the sliders also causes a constant and rapid diminishment of the lapping surface texture, rendering it less effective over time and ultimately ineffective. This is particularly true during the initial lapping passes across the slider bar 106, the part of the lapping process referred to as "rough lapping," where the dimensional part-to-part variance of the slider bars 106 is the greatest.

Figure 2:
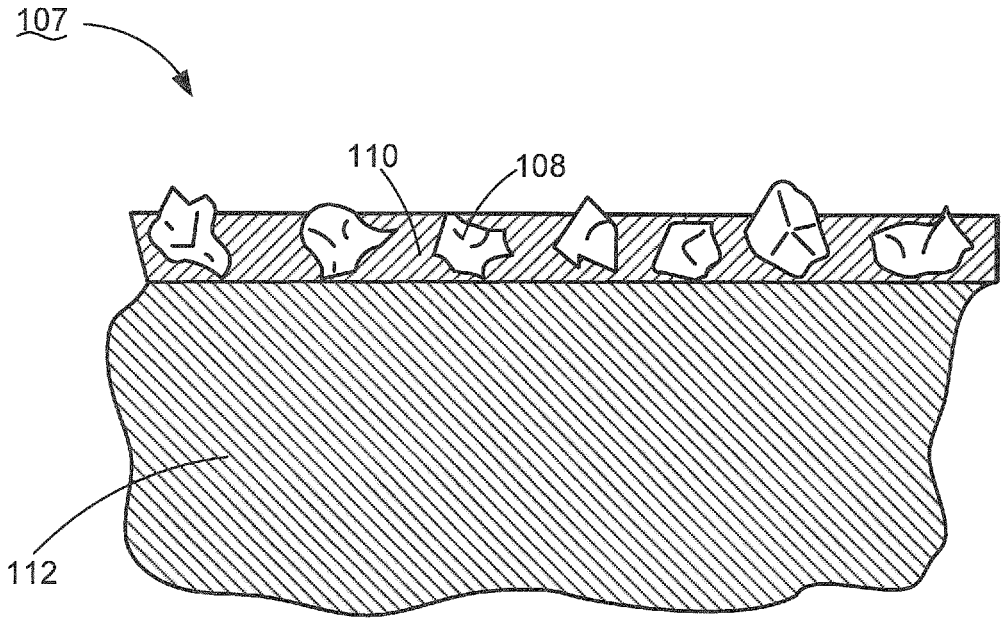
Related Art FIG. 2
FIG. 2 is a cross sectional depiction of a lapping plate in another abrading tool that is constructed in accordance with related art solutions.

FIG. 2 is a cross sectional depiction of a portion of an abrading tool 107 that is constructed in accordance with previously attempted related art solutions. A plurality of abrasive members 108 are embedded in an adhesion material 110 that is adhered to a platen 112. In that construction, the abrasive members 108 are particularly susceptible to being dislodged during rough lapping because the abrading forces against the abrasive members 108 during an intermittent and/or deep cut into the slider can exceed the sheer force that is capable of stripping the adhesion material 110 from the platen 112.

Figure 3:
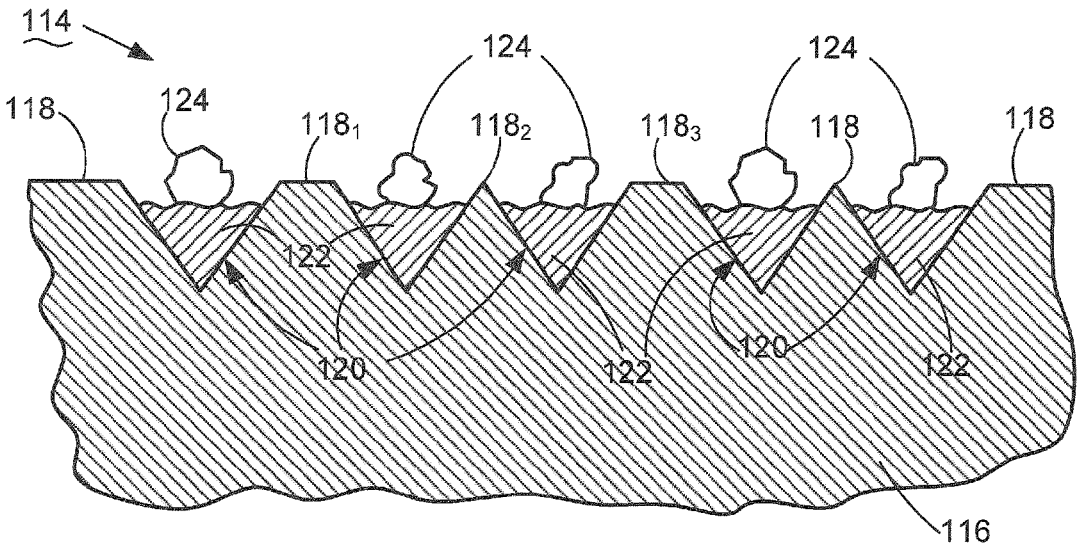
FIG. 3 is a cross sectional depiction of the lapping plate in the abrading tool of FIG. 1 that is constructed in accordance with embodiments of the present invention.

FIG. 3 is a cross sectional depiction of a portion of an abrading tool 114 that is constructed in accordance with embodiments of the present invention. The abrading tool 114 has a platen 116 that is preferably constructed of a non-compressive material, such as but not limited to being constructed of a metallic material. The platen 116 defines an external surface 118, and the metallic material construction is particularly advantageous for forming a plurality of cavities 120 in the platen 116 that intersect the external surface 118. An adhesive 122 is disposed in each of the cavities 120. An abrasive member 124 is adhered at a proximal end thereof to the platen 116 in each of the cavities 120 by the adhesive 122, so that a distal end of each abrasive member 124 extends beyond the external surface 118 to define the lapping surface.

Figure 4:
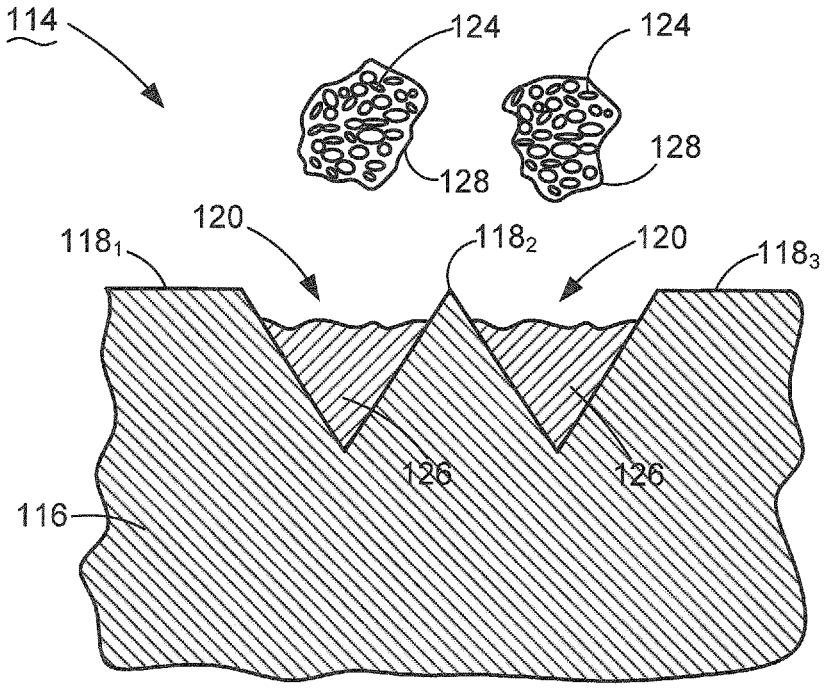
FIG. 4 is an enlarged partially exploded cross-sectional depiction of a portion of the lapping plate of FIG. 3.

FIG. 4 is an enlarged and partially exploded cross-sectional depiction of a portion of the abrading tool 114 of FIG. 3. To reduce the usage of adhesive 122, the cavities 120 are defined by non-parallel opposing surfaces—in this illustrative case forming a "V" shaped cavity 120. The adjacent V-shaped cavities 120 in FIG. 4 form a "W" shaped combination with the peak at the external surface 118, therebetween being coplanar with other planar portions of the external surface $\mathbf{118}_1$, $\mathbf{118}_3$. As depicted in FIG. 3, other pairs of adjacent V-shaped cavities 120 are separated by the planar portions of the external surface $\mathbf{118}_1$, $\mathbf{118}_3$.

The adhesive 122 can be constructed of a multi-part epoxy, wherein a first part 126 of the multi-part epoxy is applied to the platen 116 in the cavity 120 as shown in FIG. 4. A second part 128 of the multi-part epoxy can be applied to the abrasive members 124 before the first and second parts 126, 128 of the multi-part epoxy are joined together to adhere the abrasive members 124 to the platen 116. Using the second part 128 as a binder, the abrasive members 124 can advantageously be formed of diamond powder which is significantly less expensive than using larger diamond particles as in the related art solutions depicted in FIG. 2.

During reduction to practice of the claimed embodiments, a low viscosity epoxy was successfully used in a ratio of ten parts resin (such as first part 126) to one part hardener (such as second part 128). Various diamond powder sizes were successfully used, such as but not limited to 0.1, 0.25, 0.5, 1.0, 2.0, 3.0, and 6.0 microns. Thinning the epoxy is preferred as smaller diamond power sizes are used, such as by heating the epoxy or cutting it with a thinning agent such as isopropanol. The use of thermal set epoxies require baking time and temperature that tends to advantageously reduce the epoxy coating thickness, facilitating more robust and uniform abrasive particle exposure.

Figure 5:
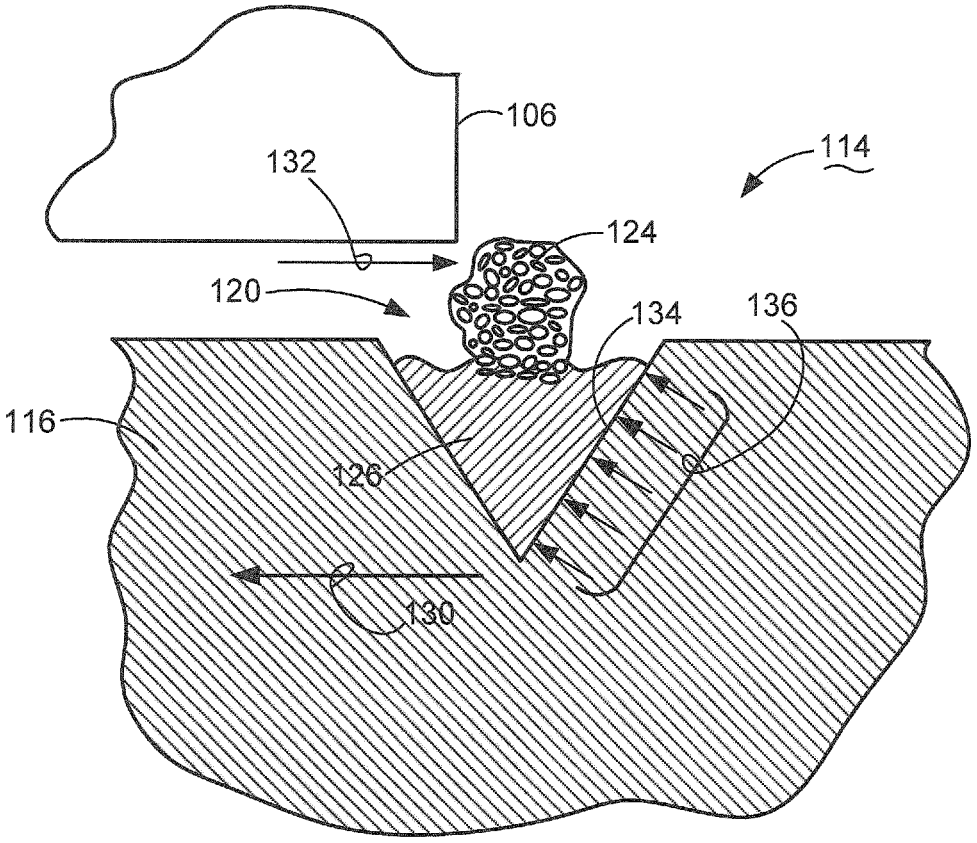
FIG. 5 is an enlarged cross-sectional depiction of a portion of the abrading tool of FIG. 1.

FIG. 5 diagrammatically depicts an enlarged portion of the abrading tool 114 of FIG. 3 at a time when the platen 116 is moving to the left as depicted by arrow 130. The abrasive member 124 is thus being moved toward and is depicted just as it is about to make an abrading contact with the slider bar 106. That abrading contact generates a substantially horizontal force against the abrasive member 124 opposite the path of movement, in a direction depicted by arrow 132. The surface 134 of the platen 116 that defines the cavity 120 supports the abrasive member 124 in opposition to the horizontal force (depicted in direction 132) with a force field depicted by arrows 136. Rooting the abrasive member 124 in the cavity 120 significantly increases the bonding strength with which it is attached, in comparison to the adhesion sheer strength of the related art solutions depicted in FIG. 2. The increased strength of the present embodiments prevents damage occurring to the texturing defining the lapping surface, thereby extending tool life and increasing operational throughput.

Figure 6:
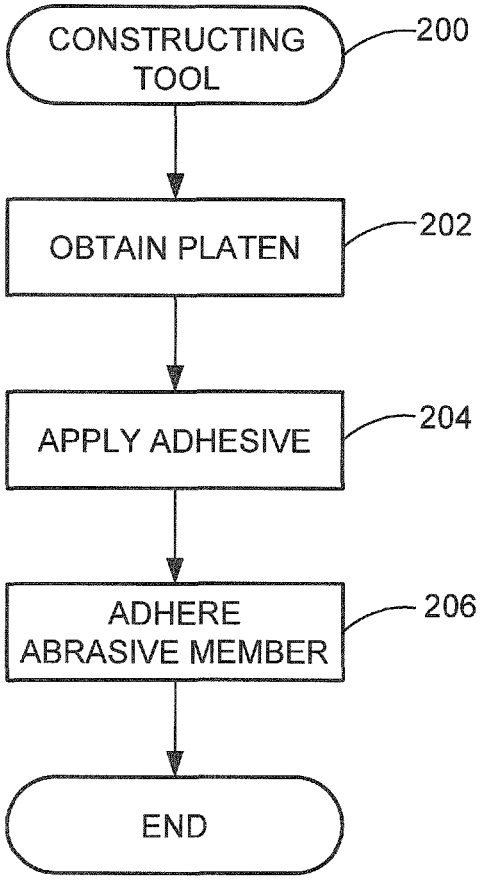
FIG. 6 is a flowchart depicting steps in a method for CONSTRUCTING A LAPPING PLATE in accordance with embodiments of the present invention.

FIG. 6 depicts steps in a method 200 for constructing the abrading tool 114 in accordance with embodiments of the present invention. The method 200 begins in block 202 with obtaining the platen that defines the external surface and the cavity intersecting the external surface. In block 204 the adhesive is applied to the platen in the cavity. As described, in some embodiments this can entail applying the first part of a multi-part epoxy in the cavity before the multiple parts of the epoxy are joined together. In block 206 the abrasive member is adhered at its proximal end to the platen by the adhesive so that a distal end of the abrasive member extends beyond the external surface to define the lapping surface. As described, in some embodiments this can entail applying the second part of the multi-part epoxy to the abrasive member, such as diamond dust, before the multiple parts of the epoxy are joined together.

Generally, the embodiments described in the foregoing are directed to an apparatus and method associated with an abrading tool for lapping a workpiece, involving a platen that is selectively moveable in relation to the workpiece and means for supporting abrasive members from the platen to define a desired surface texture for a lapping surface of the tool. For purposes of this description and meaning of the claims, "means for supporting" the abrasive members encompasses the disclosed structure and structural equivalents thereof in which the abrasive members are rooted and adhered to the platen in a cavity intersecting the platen's external surface. The "means for supporting" expressly does not include previously attempted solutions in which the abrasive members are merely adhered to the external surface and thereby maintained in place by the sheer strength of that adhesion, and does not include other previously attempted solutions in which the abrasive members are merely embedded in the platen without also being adhered to the platen by an adhesion member.

It is to be understood that even though numerous characteristics and advantages of various embodiments of the invention have been set forth in the foregoing description, together with details of the structure and function of various embodiments of the invention, this disclosure is illustrative only, and changes may be made in detail, especially in matters of structure and arrangement of parts and values for the described variables, within the principles of the present embodiments to the full extent indicated by the broad general meaning of the terms in which the appended claims are expressed.

What is claimed:

1. An abrading tool having a desired surface texture for a lapping surface of the tool, the abrading tool comprising:

a platen having a first surface and a second surface defining a cavity intersecting the first surface;

an adhesive in the cavity; and an abrasive member adhered at a proximal end thereof to the adhesive forming a non-uniform thickness of the adhesive between the abrasive member and the second surface, any respective thickness of the non-uniform thickness being orthogonal to the second surface, the abrasive member extending beyond the first surface at a distal end thereof to define the lapping surface.

2. The abrading tool of claim 1 wherein the first surface is planar.

3. The abrading tool of claim 2 wherein the second surface comprises non-parallel opposing surfaces.

4. The abrading tool of claim 3 wherein the cavity is V-shaped.

5. The abrading tool of claim 4 wherein the platen defines a plurality of the V-shaped cavities, adjacent V-shaped cavities of the plurality defining a W-shaped pair of the V-shaped cavities with a peak therebetween that is coplanar with the first surface.

6. The abrading tool of claim 4 wherein the platen defines a plurality of the V-shaped cavities, adjacent V-shaped cavities of the plurality separated by the first surface.

7. The abrading tool of claim 1 wherein the platen comprises a non-compressive construction material.

8. The abrading tool of claim 7 wherein the platen comprises a metallic construction material.

9. The apparatus of claim 1 wherein the adhesive comprises a multi-part epoxy, wherein a first part of the multi-part epoxy is operably applied to the platen in the cavity and a second part of the multi-part epoxy is operably applied to the abrasive member before the first and second parts of the multi-part epoxy are joined together to adhere the abrasive member to the platen.

10. The apparatus of claim 9 wherein the second part of the multi-part epoxy is operably applied to a plurality of abrasive members before the first and second parts of the multi-part epoxy are joined together to adhere the abrasive members to the platen.

11. The apparatus of claim 10 wherein the abrasive members comprise diamond powder.

12. A method for manufacturing an abrading tool to have a desired surface texture for a lapping surface of the tool, comprising:

obtaining a platen having a first surface and a second surface defining a cavity intersecting the first surface;

applying an adhesive to the platen in the cavity;

adhering a proximal end of an abrasive member to the adhesive forming a non-uniform thickness of the adhesive between the abrasive member and the second surface, any respective thickness of the non-uniform thickness being orthogonal to the second surface, and so that a distal end of the abrasive member extends beyond the first surface to define the lapping surface.

13. The method of claim 12 wherein the applying step is characterized by partially filling the cavity with the adhesive.

14. The method of claim 12 wherein the obtaining step is characterized by the first surface being planar.

15. The method of claim 12 wherein the obtaining step is characterized by the platen being constructed of a non-compressive material.

16. The method of claim 15 wherein the obtaining step is characterized by the platen being constructed of a metallic material.

17. The method of claim 12 wherein the applying step is characterized by applying a first part of a multi-part epoxy to the platen in the cavity.

18. The method of claim 17 wherein the adhering step is characterized by applying a second part of the multi-part epoxy to the abrasive member before joining the first and second parts of the multi-part epoxy together.

19. The method of claim 18 wherein the adhering step is characterized by applying the second part of the multi-part epoxy to a plurality of abrasive members before joining the first and second parts of the multi-part epoxy together.

20. The method of claim 19 wherein the adhering step is characterized by the abrasive members being diamond powder.

21. An abrading tool for lapping a workpiece, the abrading tool comprising:

a platen that is selectively moveable in relation to the workpiece; and means for supporting abrasive members from the platen to define a desired surface texture for a lapping surface of the tool.

* * * * *